US010106371B2

(12) United States Patent
Hanninen et al.

(10) Patent No.: US 10,106,371 B2
(45) Date of Patent: Oct. 23, 2018

(54) CONTROLLER CONFIGURED TO CONTROL ALLOCATION OF ELEVATOR CALLS BASED ON A GROUP ALLOCATION REQUEST, A SYSTEM AND A METHOD OF PERFORMING SAME

(71) Applicants: Ari Hanninen, Hyvinkaa (FI); Hannu Kuoppala, Helsinki (FI); Janne Aberg, Hyvinkaa (FI); Riku Leppaaho, Hyvinkaa (FI)

(72) Inventors: Ari Hanninen, Hyvinkaa (FI); Hannu Kuoppala, Helsinki (FI); Janne Aberg, Hyvinkaa (FI); Riku Leppaaho, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 451 days.

(21) Appl. No.: 14/870,590

(22) Filed: Sep. 30, 2015

(65) Prior Publication Data

US 2016/0016755 A1 Jan. 21, 2016

Related U.S. Application Data

(63) Continuation of application No. PCT/EP2013/057211, filed on Apr. 5, 2013.

(51) Int. Cl.

| | |
|---|---|
| ***B66B 1/34*** | (2006.01) |
| ***B66B 1/24*** | (2006.01) |
| ***B66B 1/46*** | (2006.01) |

(52) U.S. Cl.

CPC ..... *B66B 1/2408* (2013.01); *B66B 1/468* (2013.01); *B66B 2201/103* (2013.01); *B66B 2201/104* (2013.01); *B66B 2201/4615* (2013.01)

(58) Field of Classification Search

CPC . B66B 1/2408; B66B 1/468; B66B 2201/103; B66B 2201/104; B66B 2201/4615

(Continued)

(56) References Cited

U.S. PATENT DOCUMENTS 6,202,799 B1 * 3/2001 Drop ..... B66B 1/468 187/384
6,986,408 B2 * 1/2006 Takeuchi ..... B66B 1/14 187/247

(Continued)

FOREIGN PATENT DOCUMENTS

WO WO-2005070804 A2 8/2005

OTHER PUBLICATIONS

International Search Report PCT/ISA/210 for International Application No. PCT/EP2013/057211 dated Dec. 13, 2013.

(Continued)

*Primary Examiner* — Anthony Salata
(74) *Attorney, Agent, or Firm* — Harness, Dickey & Pierce, P.L.C.

(57) ABSTRACT

A controller includes a processor configured to, receive, via an input/output (I/O) device, a first destination call having a first departure floor and a first destination floor of a first passenger associated therewith, allocate the first destination call to one of the plurality of elevators, receive, via the I/O device, at least a second destination call having one or more of a second destination floor and a second departure floor of a second passenger associated therewith, and allocate the second destination call to one of the plurality of elevators such that the controller assigns the second destination call to a same one of the plurality of elevators as the first destination call, if a group allocation request associated with the first destination call and the second destination call is received from the link.

19 Claims, 1 Drawing Sheet

(58) Field of Classification Search
USPC ..... 187/247, 380–388, 391–393, 396
See application file for complete search history.

(56) References Cited

U.S. PATENT DOCUMENTS

| | | | | |
|---|---|---|---|---|
| 7,281,610 | B2 * | 10/2007 | Ylinen | B66B 1/462 187/382 |
| 7,353,915 | B2 * | 4/2008 | Zaharia | B66B 1/468 187/388 |
| 7,377,364 | B2 * | 5/2008 | Tyni | B66B 1/468 187/380 |
| 8,646,581 | B2 * | 2/2014 | Iwata | B66B 1/468 187/387 |
| 9,238,568 | B2 * | 1/2016 | Nonami | B66B 1/468 |
| 9,296,588 | B2 * | 3/2016 | Christy | B66B 1/2408 |
| 9,323,232 | B2 * | 4/2016 | Blom | G05B 13/00 |
| 9,463,954 | B2 * | 10/2016 | Kumar | B66B 1/468 |
| 9,731,934 | B2 * | 8/2017 | Stanley | B66B 1/2408 |
| 2008/0236956 | A1 | 10/2008 | Finschi | |
| 2012/0018257 | A1 | 1/2012 | Tokura | |

OTHER PUBLICATIONS

Written Opinion of the International Searching Authority PCT/ISA/237 for International Application No. PCT/EP2013/057211 dated Dec. 13, 2013.

* cited by examiner

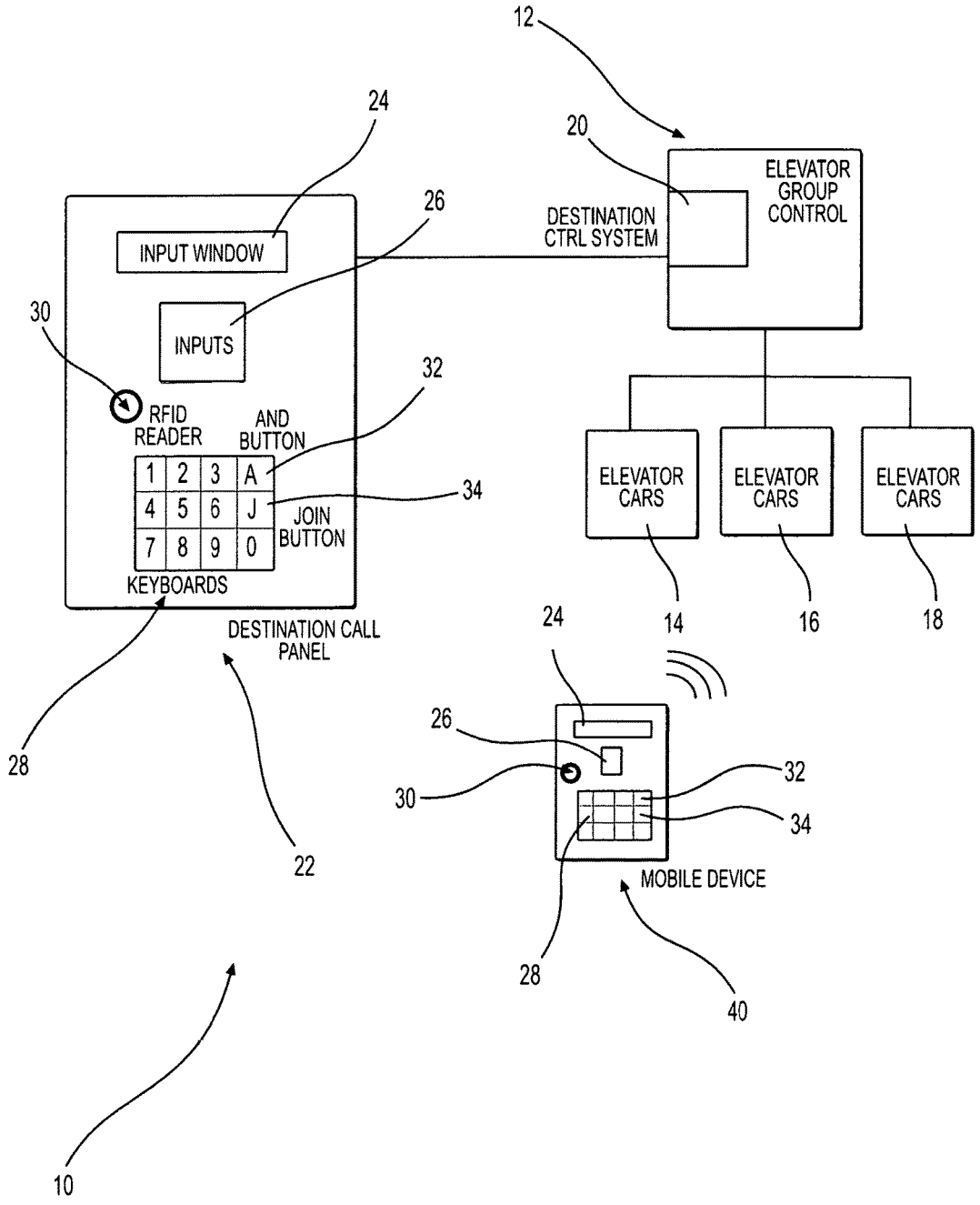
12
24
20
ELEVATOR GROUP CONTROL
26
DESTINATION CTRL SYSTEM
INPUT WINDOW
30
INPUTS
32
RFID READER
AND BUTTON
1 2 3 A
4 5 6 J
7 8 9 0
34
JOIN BUTTON
KEYBOARDS
ELEVATOR CARS
ELEVATOR CARS
ELEVATOR CARS
14
16
18
DESTINATION CALL PANEL
24
26
28
30
32
34
22
MOBILE DEVICE
28
40
10

CONTROLLER CONFIGURED TO CONTROL ALLOCATION OF ELEVATOR CALLS BASED ON A GROUP ALLOCATION REQUEST, A SYSTEM AND A METHOD OF PERFORMING SAME

This application is a continuation of PCT International Application No. PCT/EP2013/057211 which has an International filing date of Apr. 5, 2013, the entire contents of which are incorporated herein by reference.

FIELD

The present invention relates to a an elevator group control with a destination control system comprising at least one destination call panel having buttons to input a destination floor. After issuing a destination call via the panel a first elevator is allocated by the destination control system serving said destination floor. Destination control systems are particularly used in elevator groups with several elevators having quite a lot of destination floors, particularly more than ten floors. Usually after having input a destination call, the elevator is immediately allocated to said destination call and the allocated elevator is communicated to the passenger, usually via a display.

BACKGROUND

Sometimes in access controlled elevator groups, also identity data of each passenger has to be input to the destination control system, for example by inputting an access number or by presenting an identity card to reading means or wireless by RFIDs, for example.

It is object of the invention to provide a group control with destination control system which is able to consider individual travel needs in a higher amount than it is possible up to now.

SUMMARY

The object of the invention is solved with a group control. It is further solved in an allocation method. Preferred embodiments of the invention are subject-matter of the corresponding dependent claims. Some inventive embodiments are also presented in the drawings and in the descriptive section of the present invention. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. The features of the various embodiments mentioned above can be applied within the framework of the basic inventive concept in conjunction with other embodiments.

According to the invention, a passenger may issue a destination call via the destination call panel whereupon a first elevator (any of the elevators of the elevator group) is allocated to his call. The destination call panel has a link actuator, e.g. in form of a push button, which upon operation initiates the destination control system for the input of at least a second destination call with a second destination floor and/or departure floor, which second destination call is also allocated to the same first elevator.

The invention offers the advantage that two persons with different destinations and/or even departure floors could use the same elevator. Considered two passengers with different destinations meet at the lobby and discuss a problem, up to now it is a question of random whether these passengers are allocated to the same elevator. With the activation of the link actuator their separate destination calls are allocated to the same elevator. It is of course possible to activate the link activator a second time to add a third destination call to the same elevator.

In current destination control systems, the allocation of an elevator to a destination call is dependent on several allocation parameters as passenger waiting time, riding time, energy consumption, traffic flow properties and so on. It is therefore to be expected that persons with different destination floors are regularly allocated to different elevators. This is detrimental if the persons who met in the lobby of the elevator want to exchange information during the elevator travel. The invention satisfies this need in an easy manner.

Preferably, the link actuator is provided as a push button in the destination call panel which could for example indicated as "AND". Also different push buttons could be provided depending on the question whether the departure floor for both destination calls is the same, for example an "AND"-button and one "JOIN"-button. The JOIN-button allows the meeting of two persons standing on different starting floors and having the same destination floor. When the passenger presses the JOIN-button, he is invited to enter a second starting floor (aside from the floor where he enters his destination call) which initiates the destination control system to allocate a destination call with the second starting floor and the second destination floor also to the first elevator. Of course, when the second passenger has already given his destination call, his destination call can be retransferred by the destination control system to the first elevator. In case preferably mobile devices are used as a destination call panel, in which case the second passenger can be informed of the reallocation of his destination call via his mobile device.

Sometimes destination control systems have an access control wherein it is obligatory to input identification data into the destination control system before being able to input a destination floor. Sometimes together with the input of the identification data, the destination floor is input automatically. In any case of access control, the actuation of the link actuator initiates the destination control system to enable the input of another identity data and another correlated departure and/or destination floor into the destination call panel. Hereby it is irrespective whether the second departure/destination floor is input manually or automatically via the input of the identity data.

The identity data can be input via an input keypad of the destination call panel or via an identity tag reader which may be a card reader or an RFID reading device. In this case an ID tag could be presented to the ID tag reader of the destination call panel, the link actuator could be pressed and the second ID tag is presented to the ID tag reader.

In a very highly automated system the destination call panel could be reduced to an ID tag reader which automatically gets the departure and destination floors from the ID tag.

Accordingly, the invention in a very simple allows the joining of passengers having different destinations and/or different departure floors for their travel in the elevator group.

In a preferred embodiment of the invention the destination control system comprises a clock circuit for terminating the input of a destination call or of linked destination calls if no further input is received from the destination call panel within a certain time period. Via this measure it can be ensured that the input of destination calls by one passenger is terminated. The time period should be adapted to user habits with the input of data in a destination call panel, e.g. between 2 and 5 seconds. Otherwise also an "END"-button could be provided in the destination call panel to terminate the input of further destination calls to be allocated to one and the same elevator.

The invention also refers to an elevator group having a group control with a destination control system according to the above description.

The invention also refers to a method for allocating landing calls in the destination control system of an elevator group comprising several elevators. In this method, a destination call is issued to the destination control system of the elevator group by inputting a first destination floor into a destination call panel, whereupon a first elevator of the elevator group is allocated to said destination call. According to the invention, a link actuator, e.g. a push button, is provided in said destination call panel whereby the activation or operation of the link actuator allows the issuing of at least one second destination call with a second destination floor and/or a second departure floor which second destination call is also allocated to the first elevator.

The inventive method allows people with different departure and/or destination floors travelling together in the same elevator of the elevator group although it would be highly probable that according to normal allocation goals, where the passenger riding time, waiting time energy consumption or similar targets are optimized, these passengers would be allocated to different elevators.

The invention hereby even allows the joining of passengers with different departure floors and/or different destination floors. Preferably, the link actuator comprises different actuating devices, e.g. push buttons for identical departure floors or different departure floors.

If the departure floors are the same, i.e. the floor on which the destination call is issued, the passenger my press an "AND"-button of the link actuator on the destination call panel, whereupon the destination control system simply awaits the input of a second destination floor or, if the destination control system is access controlled, the input of a second passenger ID, which may comprise a correlated second destination floor. Both destination calls are then allocated to the same elevator of the elevator group.

If the other passengers will enter the elevator at a different departure floor, the passenger preferably adds a different activator of the link actuator as e.g. a "JOIN"-button of the link actuator whereupon the passenger can enter the allocated elevator at a different departure floor. If desirable, the other passenger even may head for a different destination floor. If he doesn't enter a second destination floor, both calls are deemed to comprise the same destination floor. In case the JOIN-button is pressed and the second destination call has been input into the destination call panel, the destination control system scans the given destination calls for a destination call having the specified departure and destination floor and allocates this/these destination call(s) also to the same elevator. If no destination call with the second departure floor and the second destination floor has been given, the destination control system will allocate the next destination call with said departure/destination data to the same elevator.

Via this method it is therefore possible that passengers with different departure and/or destination floors travel with the same elevator in the elevator group.

When the invention speaks of a destination call panel as an input means, this also comprises the destination call input means on mobile devices which allow for the automatic, semi-automatic or manual input of identity data and/or destination and/or departure floors into the destination control system.

The destination call panels could be reduced to automatic ID reading devices which include all the departure/destination data. In this case the link activator could be provided in connection with the automatic ID reading device, e.g. an ID tag reader.

The invention is particularly designed for a destination control system with immediate call allocation although it is not limited to such systems. The identity data can be input to the destination control system via identity cards, RFID tags or similar devices which are per se known in the art.

The invention could also be used in a multi-group system having several elevator groups which are commonly handled by a multi-group control.

The destination control system is preferably provide in the group control but can also be located elsewhere, e.g. in an elevator control of the elevator group.

BRIEF DESCRIPTION OF THE DRAWINGS

The invention will hereinafter be described by the aid of an exemplary embodiment in connection with the drawing.

FIG. 1 shows a schematic drawing of an elevator group with destination control system according to the invention.

DETAILED DESCRIPTION

FIG. 1 shows an elevator group 10 having an elevator group control 12 to which three elevators 14, 16, 18 are connected. The elevator group control 12 comprises a destination control system 20 which is connected to several destination call panels 22 located at different floors in the lobby of the elevators. Each destination call panel comprises an input window 24, a display 26 for the allocated elevator, a decade keyboard 28 for inputting the destination call and an RFID reader 30 to read RFID tags. The destination call panel further comprises an AND-button 32 and a JOIN-button 34.

The destination control system can also communicate wirelessly with a mobile device 40, e.g. a smartphone, which comprises the same functional elements as the destination call panel 22 in a software based application, whereby identical elements or elements with the same function have the same reference number.

The elevator group 10 in FIG. 1 works as follows:

The passenger enters a destination call into the destination call panel 22 by inputting a first destination floor via the decade keyboard 28 or via an ID tag presented to the RFID tag reader 30. After having given his destination call, he presses the AND-button 32 to input a second destination floor via the decade keyboard 28. Alternatively another passenger may present his ID tag to the ID tag reader 30 of the destination call panel. When within a certain time frame the AND- or JOIN button 32, 34 is not pressed a further time, the destination control issues an elevator 14 to both destination calls which elevator is indicated on the display 26 of the destination call panel. The elevator is of course allocated in line with the usual optimization criteria of elevator call allocation, e.g. passenger riding time or waiting time.

If the passenger wants another passenger with a different departure floor to join his travel in the elevator group, he presses the JOIN-button 34 after having issued his own destination call, in which case he is able to input a different departure floor into the destination call panel. In this connection it could also be possible to input for the second destination call a different second destination floor so that it is possible that passengers with different departure floors as well as with different destination floors travel together. In access controlled systems the passenger would have to input the ID of the further passenger manually.

The issuing of corresponding destination calls can also be performed on a mobile device 40. If the destination control system is an access-controlled destination control system, the identity of the passengers could already be communicated to the destination control system via the serial number of the mobile device. In this case, he can enter the identity of the second passenger other by input the second identity data via the decade keyboard 28 or via an ID tag reader 30 in the mobile device.

The invention provides the possibility of social contacts of passengers during a travel in an elevator system although they have different departure and/or destination floors.

Of course, the above-mentioned embodiment is not limited to elevator groups with three elevators. Also the elevator group 10 may be a multi-group system comprising several groups of elevators controlled by a multi-group control system. In this case, the destination control system is preferably provided in the multi-group control.

Furthermore, it is apparent to the skilled person that the destination call panels may be designed differently, i.e. having different input means than a decade keyboard or having the input window 24 and the display 26 provided in one and the same display element. In a very simplified form the destination call panel only may comprise an TD tag reader and the link actuator.

It is furthermore clear that the ID tag reader 30 is optional and that the destination call panel also may have other ID readers as e.g. card readers etc.

The invention can be modified within the scope of the appended patent claims.

The invention claimed is:

1. A controller configured to control allocation of elevator calls among a plurality of elevators, the controller comprising:

an input/output (I/O) device configured to communicate with least one destination call panel having a link actuator associated therewith; and a processor configured to, receive, via the I/O device, a first destination call having a first departure floor and a first destination floor of a first passenger associated therewith, allocate the first destination call to one of the plurality of elevators, receive, via the I/O device, at least a second destination call having one or more of a second destination floor and a second departure floor of a second passenger associated therewith, and allocate the second destination call to one of the plurality of elevators such that the controller assigns the second destination call to a same one of the plurality of elevators as the first destination call without cancelling the first destination call, if a group allocation request associated with the first destination call and the second destination call is received from the link actuator.

2. The controller of claim 1, wherein the link actuator includes at least one push button associated with a respective one of the least one destination call panels.

3. The controller of claim 2, wherein the at least one push button includes an "AND"-button configured to initiate the group allocation request and receive an input of the second destination call including the second destination floor associated therewith.

4. The controller of claim 2, wherein the at least one push button includes a JOIN button configured to initiate the group allocation request and receive input of the second destination call including the second departure floor associated therewith, the second departure floor being a different floor from the first departure floor.

5. The controller of claim 4, wherein the controller is configured to receive the second destination floor with the second destination call, if the user initiates the group allocation request via the JOIN button.

6. The controller according to claim 1, wherein the at least one destination call panel comprises:

a mobile device configured to bi-directional wirelessly communicate with the I/O device of the controller.

7. The controller of claim 6, wherein the controller is configured to, determine if a prior destination call associated with the second passenger is pending, re-allocate the prior destination call to the same one of the plurality of elevators, if the controller determines that the prior destination call is pending, and transmit, via the I/O device, a reallocation-message to the mobile device, the reallocation-message informing the second passenger of the group allocation request.

8. The controller according to claim 1, wherein the controller is configured to, receive from the destination call panel first identification data (ID) of the first passenger associated with the first destination call, and request input of at least one second ID of the second passenger associated with the second destination call and one or more of the second destination floor and second departure floor.

9. The controller according to claim 8, wherein the controller is configured to receive the first ID and the second ID from one or more wireless ID-tag readers.

10. The controller according to claim 1, wherein the processor is configured to, count an elapsed time from input of the first destination call;

terminate the group allocation request if the second destination call is not received from the destination call panel before the elapsed time reaches a threshold.

11. An elevator system comprising:

the controller according to claim 1; and the plurality of elevators configured to transport the passenger and the second passenger.

12. A method for allocating elevator calls among a plurality of elevators, the method comprising:

receiving a first destination call having a first departure floor and a first destination floor of a first passenger associated therewith;

first, allocating the first destination call to one of the plurality of elevators;

receiving at least a second destination call having one or more of a second destination floor and a second departure floor of a second passenger associated therewith; and second allocating the second destination call to one of the plurality of elevators such that the second allocating allocates the second destination call to a same one of the plurality of elevators as the first destination call without cancelling the first destination call, if a group allocation request associated with the first destination call and the second destination call is received from a link actuator.

13. The method according to claim 12, wherein the second allocating comprises:

determining if a prior destination call associated with the second passenger is pending;

re-allocating the prior destination call to the same one of the plurality of elevators, if the determining determines that the prior destination call is pending.

14. The method according to claim 13, further comprising:

transmitting a re-allocation message to the second passenger, the reallocation-message informing the second passenger of the group allocation request, if the determining determines that the prior destination call is pending.

15. The method according to claim 12, further comprising:

receiving first identification data (ID) of the first passenger associated with the first destination call; and requesting input of at least one second ID of a second passenger associated with the second destination call and one or more of the second destination floor and second departure floor.

16. An elevator system comprising:

one or more destination call devices including a link actuator configured to receive a group allocation request to assign a first destination call and a second destination call to a same one of a plurality of elevators, the first destination call and the second destination call each having one or more of a departure floor and destination floor associated therewith; and a controller configured to, receive the first destination call associated with a first passenger, allocate the first destination call to one of the plurality of elevators, receive the second destination call associated with a second passenger, and assign the second destination call to one of the plurality of elevators such that the second destination call is assigned to a same one of the plurality of elevators as the first destination call without cancelling the first destination call, if the first destination call and the second destination call are associated with the group allocation request.

17. The elevator system of claim 16, wherein the one or more destination call devices includes an input device configured to receive the group allocation request and an input of the second destination call including one or more of the second destination floor and the second departure floor associated therewith, the second departure floor associated with the second passenger being a different floor from the first departure floor associated with the first passenger.

18. The elevator system of claim 16, wherein the controller is configured to, determine if a prior destination call associated with the second passenger is pending, and re-allocate the prior destination call to the same one of the plurality of elevators, if the controller determines that the prior destination call is pending.

19. The elevator system of claim 18, wherein the controller is configured to transmit a re-allocation message to the second passenger informing the second passenger of the group allocation request, if the controller determines that the prior destination call is pending.

* * * * *